US007974560B2

(12) United States Patent
Nakajima et al.

(10) Patent No.: US 7,974,560 B2
(45) Date of Patent: Jul. 5, 2011

(54) FIXING DEVICE AND IMAGE FORMING APPARATUS COMPRISING THE SAME

(75) Inventors: Eiji Nakajima, Osaka (JP); Takatoshi Nishimura, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/711,300

(22) Filed: Feb. 24, 2010

(65) Prior Publication Data

US 2010/0221047 A1 Sep. 2, 2010

(30) Foreign Application Priority Data

Feb. 27, 2009 (JP) ..... 2009-045261

(51) Int. Cl.
*G03G 15/20* (2006.01)

(52) U.S. Cl. ..... 399/323; 399/122; 399/331; 219/216

(58) Field of Classification Search ..... 399/122, 399/320, 322–323, 328–331; 219/216, 243–244
See application file for complete search history.

(56) References Cited

U.S. PATENT DOCUMENTS 4,408,757 A * 10/1983 Yarm ..... 271/311
2005/0013638 A1* 1/2005 Fukuda et al. ..... 399/323
2007/0140752 A1 6/2007 Yamamoto et al.

FOREIGN PATENT DOCUMENTS

JP 2007-171372 7/2007

* cited by examiner

*Primary Examiner* — David P Porta
*Assistant Examiner* — Benjamin Schmitt
(74) *Attorney, Agent, or Firm* — Gerald E. Hespos; Michael J. Porco

(57) ABSTRACT

A separation mechanism of a fixing device includes a separation member extending in a direction orthogonal to the paper convey direction and arranged opposite the fixing member in a state apart from the fixing member by a predetermined gap, a support shaft member extending in a direction orthogonal to the paper convey direction and rotatably supporting the separation member, a first gap adjustment unit capable of rotating the separation member around the support shaft member to adjust the predetermined gap in the rotation direction, and a second gap adjustment unit capable of moving the separation member in a direction in which an imaginary surface from the support shaft member towards the fixing member extends, to adjust the predetermined gap in the surface direction.

16 Claims, 6 Drawing Sheets

FIXING DEVICE AND IMAGE FORMING APPARATUS COMPRISING THE SAME

BACKGROUND OF THE INVENTION

1. Field of the Invention

The present invention relates to a fixing device that causes a toner image on a paper to be fixed to that paper at a nip area formed between a fixing member and a pressing member, and to an image forming apparatus comprising the same.

2. Description of the Related Art

A fixing device of -an image forming apparatus generally includes a fixing roller, or a fixing belt (fixing member) wound onto the fixing roller, and a pressing roller (pressing member) that contacts the fixing member to form a nip area between itself and the fixing member. A toner image on a paper that is conveyed in is thermally fixed onto the paper in the nip area. With the fixing device, there are cases where a paper that has undergone the fixing process is discharged from the nip area while being stuck to the fixing member, and in these cases problems are caused such as paper jam.

To eliminate such problems, in a first technology for example, the fixing device is provided with a separation mechanism, which is configured so as to be capable of stripping from the fixing member the paper that has stuck to the fixing member after the fixing process. The separation mechanism has a single separation claw (separation member) that extends along the longitudinal direction of the fixing roller and that is arranged facing the fixing roller. A gap between the separation claw and the fixing roller is set to a predetermined magnitude and due to this the separation claw touches the paper that has stuck to the fixing roller and is able to strip the paper from the fixing roller.

In the first technology, a spacer that is installed near a leading edge of the separation claw is used a means for setting the gap to a predetermined magnitude. The spacer is set in position so as to abut the core of the fixing roller, and therefore a gap of the predetermined magnitude is formed between the leading edge of the separation claw and the peripheral surface of the fixing roller.

However, only a single separation claw is used in the separation mechanism of the first technology, and therefore due to unevenness in the dimensional precision of the separation claw itself, it is difficult to set the gap to the predetermined magnitude. As a result, it is difficult to strip away the paper that has stuck to the fixing roller and there is a risk that paper jam will occur.

SUMMARY OF THE INVENTION

Accordingly, in light of the above situation, an object of the present invention is to provide a fixing device and an image forming apparatus provided with same in which it is easy to set the gap between the separation member and the fixing member to a predetermined magnitude even in a case where only a single separation member is employed.

To achieve the aforementioned object, a fixing device according to the present invention includes a fixing member, a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone the fixing process. The separation mechanism includes a separation member extending in a direction orthogonal to the paper convey direction and arranged opposite the fixing member in a state apart from the fixing member by a predetermined gap, a support shaft member extending in a direction orthogonal to the paper convey direction and rotatably supporting the separation member, a first gap adjustment unit capable of rotating the separation member around the support shaft member to adjust the predetermined gap in the rotation direction, and a second gap adjustment unit capable of moving the separation member in a direction in which an imaginary surface from the support shaft member towards the fixing member extends, to adjust the predetermined gap in the surface direction.

DETAILED DESCRIPTION OF THE PREFERRED EMBODIMENTS

Hereinafter, preferred embodiments for executing the present invention are described in detail while referencing the accompanying drawings.

Figure 1:
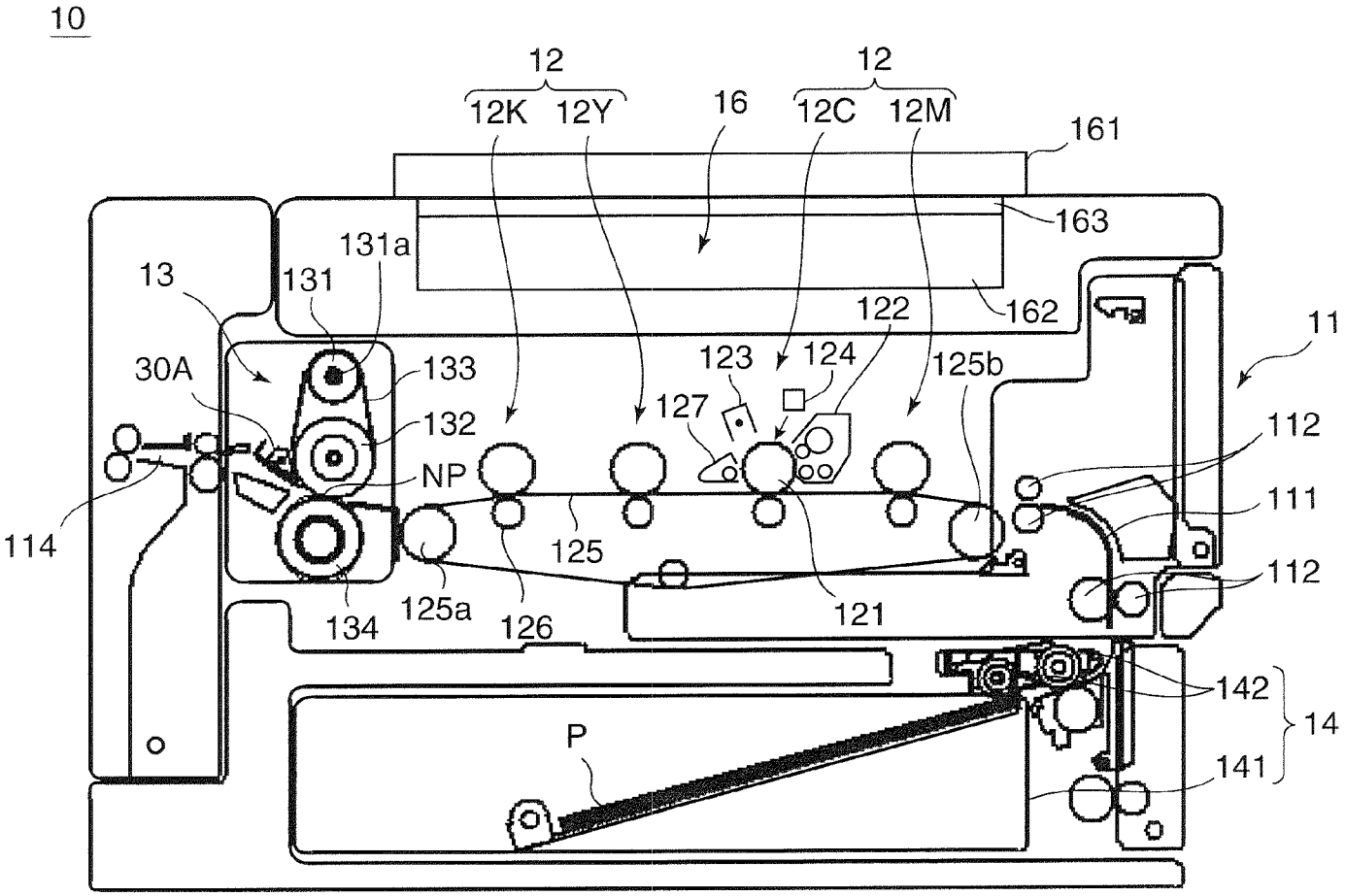
FIG. 1 is an explanatory diagram of a front cross-sectional view for describing an internal structure of an image forming apparatus in which is applied a fixing device according to a first embodiment of the present invention.

First, description is given using FIG. 1 regarding an outline of an image forming apparatus provided with a fixing device according to an embodiment of the present invention. FIG. 1 is an explanatory diagram of a front cross-sectional view for describing an embodiment of an internal structure of an image forming apparatus. An image forming apparatus 10 is used as a copier for color printing and includes as a basic configuration an apparatus conveying body 11, and an image reading device 16 that reads original images and which is provided at an upper section of the apparatus main body 11.

The apparatus main body 11 is internally provided with an image forming section 12, which forms a toner image based on image information of a document that has been read by the image reading device 16, a fixing device 13, which executes a fixing process on the toner image that has been transferred onto a paper P by the image forming section 12, and a paper storage section 14 that stores papers P.

The image reading device 16 includes a contact glass 163, which is installed on an upper surface of the image reading device 16 and on which the document is placed, a document presser 161, which is provided so as to be readily openable/closeable with respect to the contact glass 163 in order to press on the document that has been placed on the contact glass 163, and an optical system unit 162, which is arranged below the contact glass 163 and reads an original image of the document on the contact glass 163. The optical system unit 162 is configured to scan an original surface of the document through the contact glass 163 from below using a light source and to read reflected light from the original surface using a CCD (charge coupled device). The image information of the document that has been read by the CCD undergoes digitalization and is outputted to an exposure device 124 of the image forming section 12.

The optical system unit 162 is provided with components such as an unshown light source, a plurality of mirrors, a lens unit, and the CCD (charge coupled device). Light from the light source is reflected by the original surface, and this reflected light is inputted to the CCD as original information via the mirrors and the lens unit. The original information, which is inputted to the CCD as analog amounts, is converted to digital signals and stored in a predetermined storage device.

The image forming section 12 forms toner images on the papers P supplied from the paper storage section 14, and is constituted by a magenta unit 12M, a cyan unit 12C, a yellow unit 12Y, and a black unit 12K, which are successively arranged from an upstream side (right side of the page in FIG. 1) to a downstream side. Each of the units 12M, 12C, 12Y, and 12K includes a photosensitive drum 121 and a development device 122. Each of the photosensitive drums 121 receives a supply of toner from its corresponding development device 122 while rotating in a counterclockwise direction in FIG. 1. Unshown toner containers are provided inside the apparatus main body 11 in appropriate locations corresponding to the development devices 122, and toner from the toner containers is supplied to the development devices 122.

Each of the units 12M, 12C, 12Y, and 12K further includes a charger 123 and an exposure device 124 constituted by components such as an LED, which are arranged in positions directly above the photosensitive drums 121. The peripheral surface of each of the photosensitive drums 121 is charged uniformly by the charger 123. A corresponding laser beam for each color is radiated from each of the exposure devices 124 onto the peripheral surface of the charged photosensitive drums 121 based on image data that has been inputted by the image reading device 16. In this manner, electrostatic latent images are formed on the peripheral surfaces of the photosensitive drums 121. Then, a toner image is formed on each peripheral surface of the photosensitive drums 121 respectively by supplying toner of each color from the development devices 122 to the electrostatic latent images.

A conveying belt 125 is provided at a position below the photosensitive drums 121. The conveying belt 125 is a belt that conveys the papers P from the paper storage section 14 from the magenta unit 12M, which is on the most upstream side, to the black unit 12K, which is on the most downstream side, and is arranged spanning between a drive roller 125*a* and an driven roller 125*b*. The conveying belt 125 circles counterclockwise around the drive roller 125*a* and the driven roller 125*b* in synchronization with the photosensitive drums 121 in a state in which the conveying belt 125 is pressed against the peripheral surface of each of the photosensitive drums 121 due to primary transfer rollers 126, which are provided corresponding to each of the photosensitive drums 121. A nip area is formed between each of the photosensitive drums 121 and its corresponding primary transfer roller 126 through which passes the paper P conveyed by the conveying belt 125.

When the paper P is guided from the paper storage section 14 through a paper convey path 111, which is described later, onto the conveying belt 125 and conveyed from the magenta unit 12M, which is on the most upstream side, to the black unit 12K, which is on the most downstream side, the toner image on the peripheral surface of each of the photosensitive drums 121 is transferred onto the paper P. Specifically, accompanying the circling of the conveying belt 125, first a magenta toner image is transferred onto the surface of the paper P by the photosensitive drum 121 of the magenta unit 12M. Following this, transfer of a cyan toner image is carried out in a superimposed manner by the photosensitive drum 121 of the cyan unit 12C onto a transfer position of the magenta toner image on the conveying belt 125. Thereafter, transfer of a yellow toner image by the yellow unit 12Y and transfer of a black toner image by the black unit 12K are carried out similarly in a superimposed manner. In this way, a color toner image is formed on the surface of the paper P.

A cleaning device 127 is provided at a leftward position in FIG. 1 for each of the photosensitive drums 121. The cleaning devices 127 perform cleaning by removing residual toner on the peripheral surface of the photosensitive drums 121 after the toner images have been transferred from the photosensitive drums 121 onto the paper P. The peripheral surface of the photosensitive drum 121, which has undergone the cleaning process by the cleaning device 127, moves toward the charger 123 for a new charging. Waste toner that has been removed from the peripheral surfaces of the photosensitive drums 121 by the cleaning devices 127 is collected in an unshown toner collection bottle by way of a predetermined route.

The paper storage section 14 is provided at a position underneath the image forming section 12 and the fixing section 13. The paper storage section 14 is provided with a paper tray 141 that stores a bundle of the papers P and is detachably mounted at the aforementioned underneath position. In FIG. 1, the paper tray 141 is provided as a single level, but two or more levels may be provided. The papers P are drawn out sheet by sheet from the paper tray 141 by the drive of a pickup roller 142. A paper P that has been drawn out is conveyed to the conveying belt 125 through the paper convey path 111.

The paper convey path 111 is a convey path that extends from a rightward position of the paper storage section 14 to a vicinity of the driven roller 125*b*. Conveying roller pairs 112 are provided in appropriate locations on the paper convey path 111, and the papers P from the paper storage section 14 are conveyed by the drive of the conveying roller pairs 112 to the conveying belt 125.

The fixing device 13 executes a fixing process on the toner image on the paper P that has been transferred by the image forming section 12. The fixing device 13 includes a heating roller 131, which is provided internally with a heater 131*a* as a heat source, a fixing roller 132 arranged in opposition to the heating roller 131, a fixing belt 133 provided spanning between the fixing roller 132 and the heating roller 131, and a pressing roller (pressing member) 134, which is arranged in opposition to the fixing roller 132 through the fixing belt 133. A nip area NP through which the papers P pass is formed between the fixing belt 133 and the pressing roller 134. The paper P, on which a toner image has been transferred, is pressed and sandwiched between the fixing roller 132 and the pressing roller 134 at the nip area NP while receiving heat from the fixing belt 133. In this way, a color toner image having a stabilized state is formed on the paper P. In the present embodiment, the fixing roller 132 and the fixing belt 133 constitute a fixing member.

There are cases where a paper P, after undergoing the fixing process at the nip area NP, is discharged from the nip area NP while being stuck to the fixing belt 133, and in these cases problems are caused such as paper jam. A separation mechanism 30A is provided in the fixing device 13 to eliminate such problems. The separation mechanism 30A is configured to be capable of stripping the paper P from the fixing belt 133 in a case where the paper P has passed through the nip area NP while being stuck to the fixing belt 133 after the fixing process.

The paper P, on which a color image is adhered after the fixing process is completed, is discharged to an unshown paper discharge tray provided on a left side wall of the apparatus main body 11 by way of a paper discharge convey path 114, which is provided extending from the fixing section 13.

First Embodiment

Figure 2:
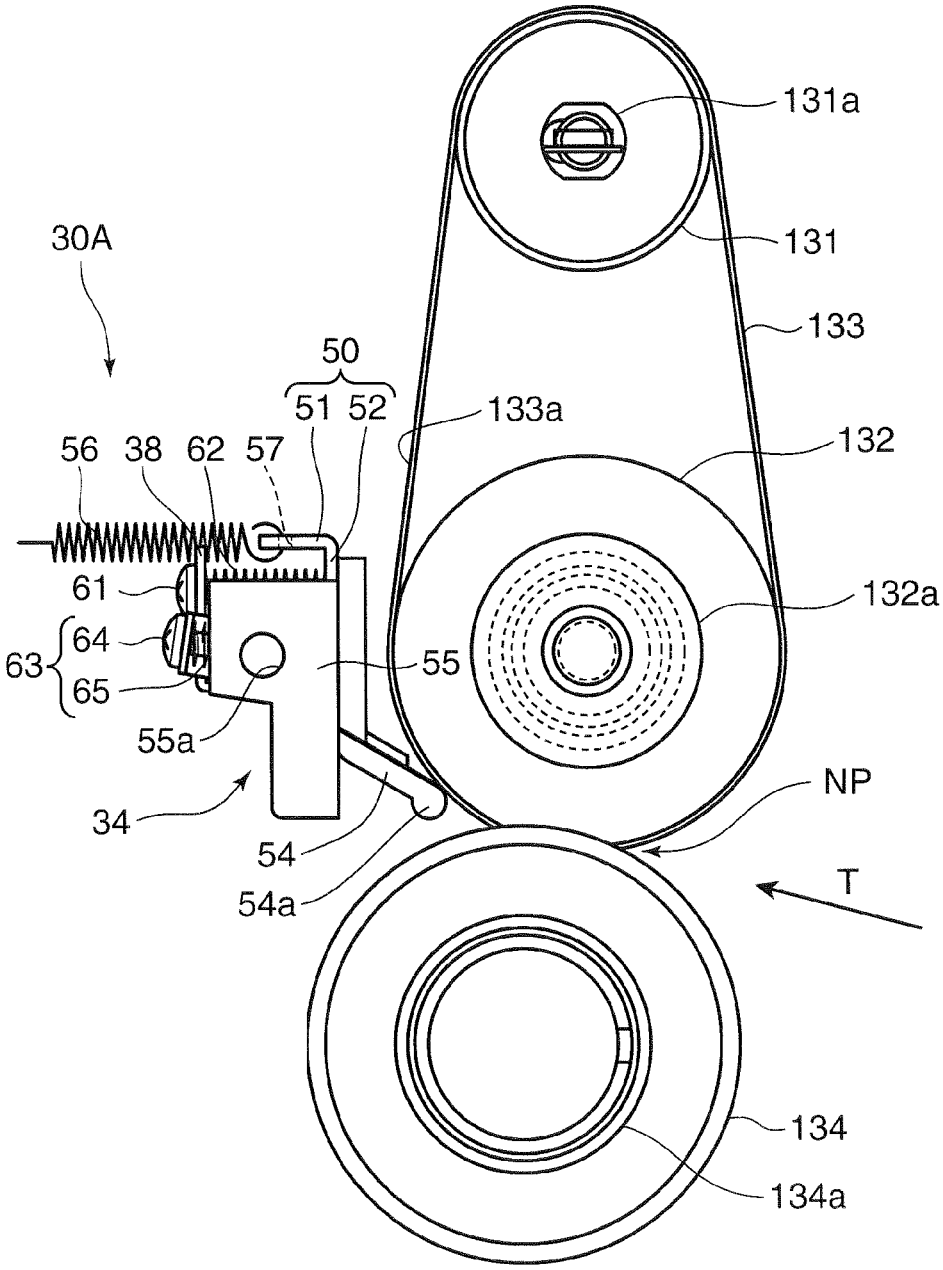
FIG. 2 is an outline diagram for describing main components of the fixing device.

Hereinafter, description is given with reference to FIG. 2 regarding the fixing device 13 according to a first embodiment. FIG. 2 is a front view outline diagram for describing main components of the fixing device 13. As stated earlier, the fixing device 13 includes the heating roller 131, the fixing roller 132, the fixing belt 133, which is provided spanning between the heating roller 131 and the fixing roller 132, the pressing roller 134, which is arranged in opposition to the fixing roller 132 through the fixing belt 133, and the separation mechanism 30A, which is arranged in opposition to the fixing roller 132 through the fixing belt 133.

The heating roller 131 has an aluminum core and is a roller on which a fluorocarbon resin coating has been implemented on the core and that is internally provided with the heater 131*a*. The fixing roller 132 has an iron core and is a roller on which a silicone rubber has been applied on that core. The pressing roller 134 has an aluminum core and is a roller on which a silicone rubber has been applied on that core, and on which a PFA tube is further provided on the silicone rubber. The fixing belt 133 that is wound around the heating roller 131 and the fixing roller 132 has a nickel substrate, and is a belt on which a silicone rubber is provided on that substrate, and on which a PFA tube is further provided on the silicone rubber.

The heating roller 131, the fixing roller 132, and the pressing roller 134 are rollers whose longitudinal directions are directions orthogonal to a convey direction T (FIG. 2) on which the papers P are conveyed from the image forming section 12 to the nip area NP of the fixing device 13, and an unshown rotational shaft of the heating roller 131, a rotational shaft 132*a* of the fixing roller 132, and a rotational shaft 134*a* of the pressing roller 134 are set parallel to each other. A width dimension of the fixing belt 133 that is wound around the fixing roller 132 is set substantially equivalent or less than a longitudinal direction dimension of the fixing roller 132. The separation mechanism 30A is arranged at a downstream side from the fixing roller 132 and the pressing roller 134 in the paper convey direction T, that is, at a downstream side from the nip area NP.

Figure 3:
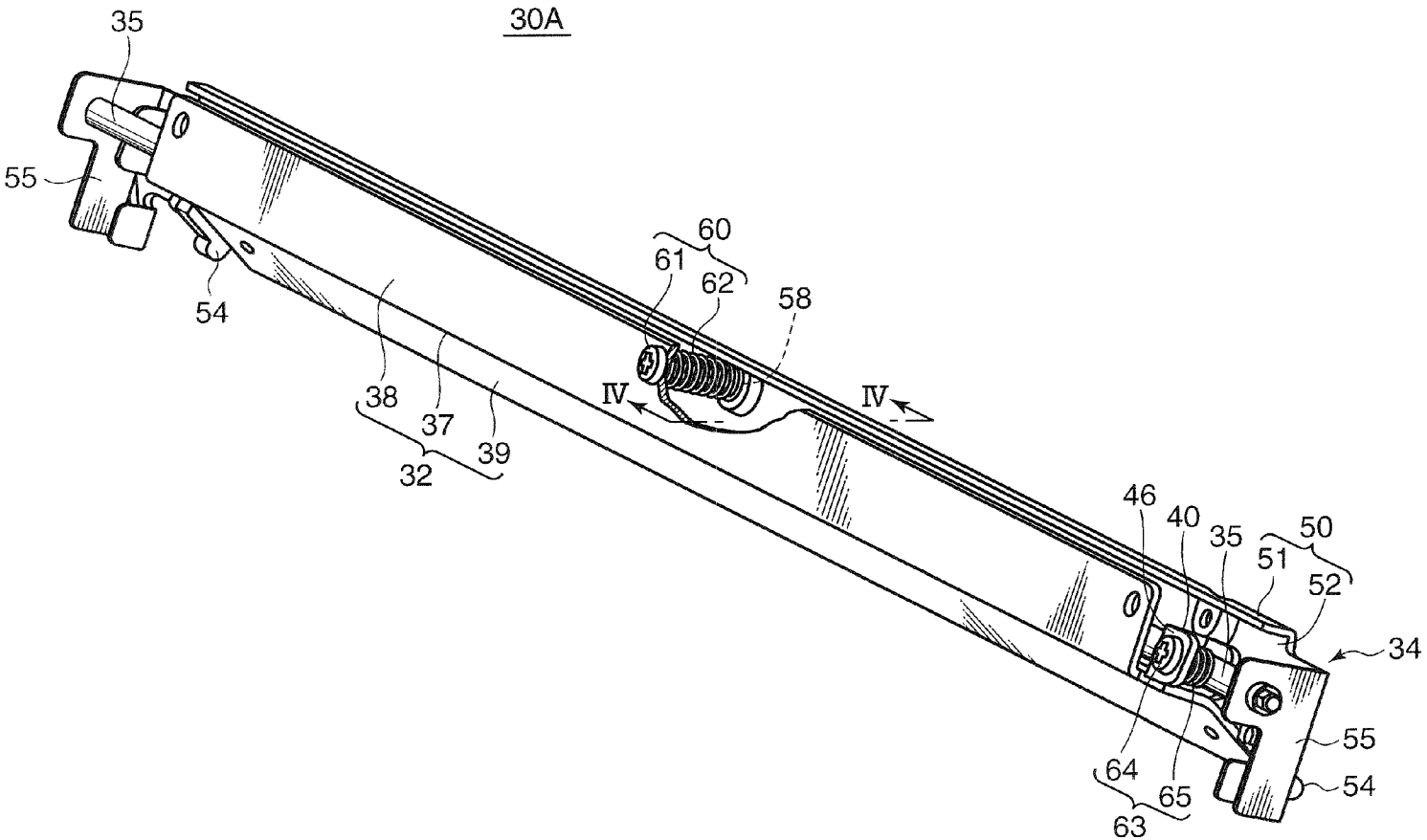
FIG. 3 is a perspective view of a separation mechanism of FIG. 2 as viewed from a left side.
Figure 4:
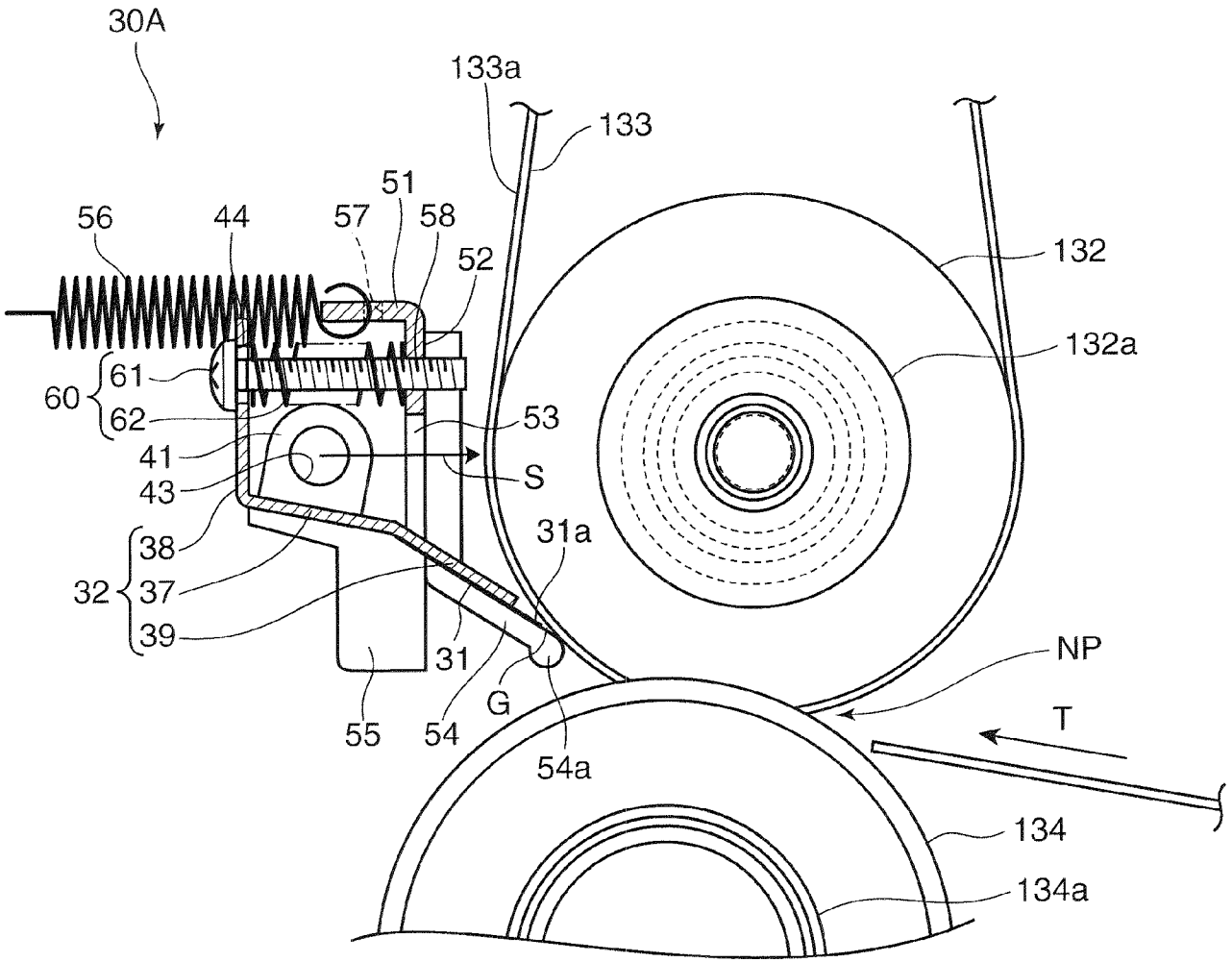
FIG. 4 is a diagram of the separation mechanism as viewed along a line IV to IV of FIG. 3.
Figure 5:
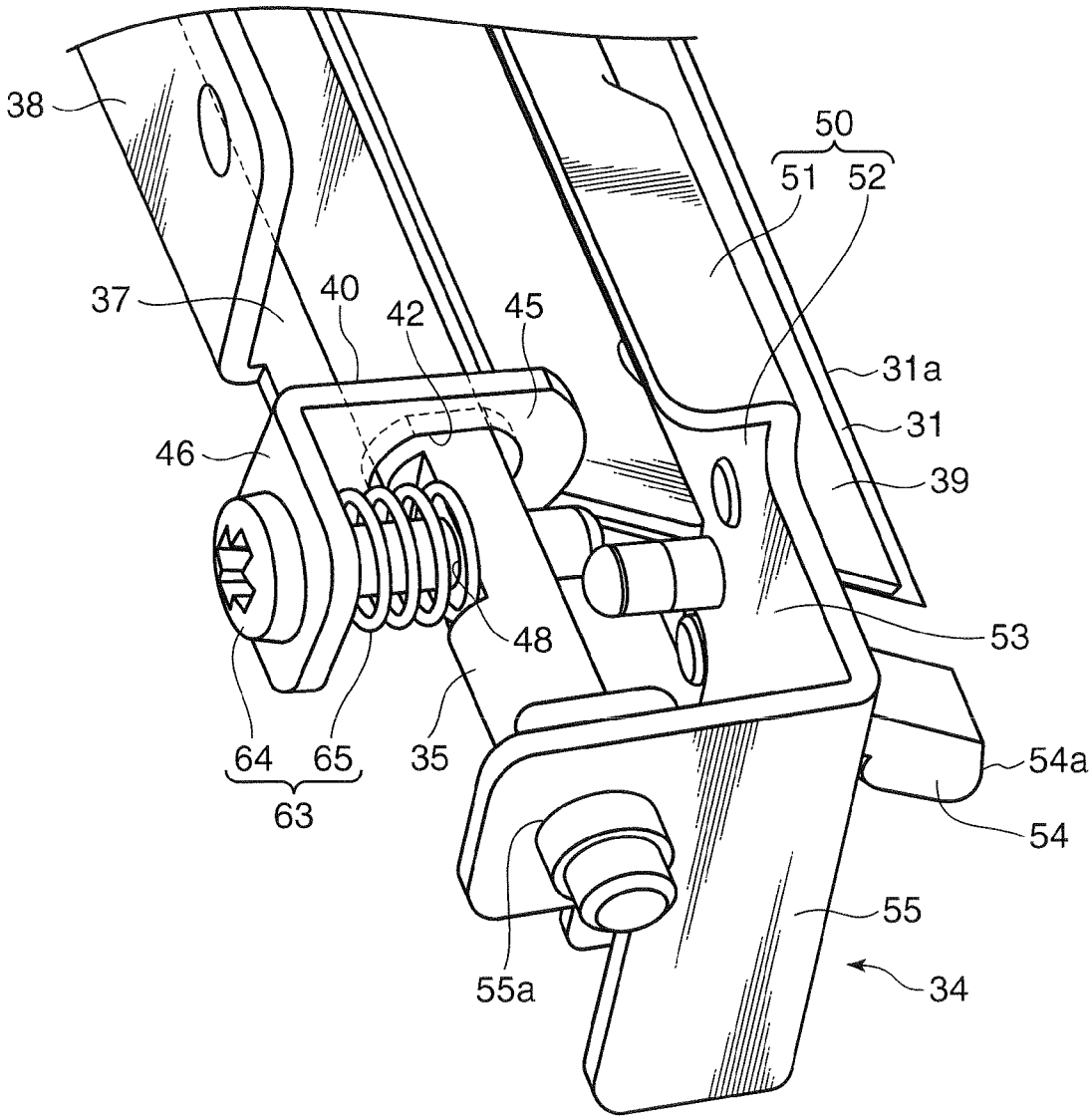
FIG. 5 is an enlarged diagram showing one end longitudinal direction portion of the separation mechanism shown in FIG. 3.

Next, description is given regarding the separation mechanism 30A with reference to FIG. 3 to FIG. 5, in addition to FIG. 2. FIG. 3 is a perspective view of the separation mechanism 30A of FIG. 2 as viewed from the left side, and FIG. 4 is a diagram of the separation mechanism 30A as viewed along a line IV to IV of FIG. 3. FIG. 5 is an enlarged diagram in which one end portion of the separation mechanism 30A shown in FIG. 3 has been enlarged. As basic components, the separation mechanism 30A is provided with a separation plate 31 (separation member) (FIG. 4) that is arranged in opposition to the fixing belt 133 in a state apart from a surface 133*a* of the fixing belt 133 by a predetermined gap, a separation plate holder 32 on which the separation plate 31 is attached, a support member 34, and a support shaft member 35 that supports the separation plate holder 32 and the support member 34.

As shown in FIG. 4, the separation plate holder 32 is a member whose cross section as viewed from the longitudinal direction of the fixing roller 132 forms a substantial L shape, and is provided with a holder main body portion 37 that extends along the longitudinal direction of the fixing roller 132, a upright wall (opposing wall) 38 that extends upward from an edge (left edge in FIG. 4) extending along the longitudinal direction of the holder main body portion 37, and a holding portion 39 that extends diagonally downward toward the fixing belt 133 from a right edge on an opposite side from the left edge.

The separation plate 31 is attached at a lower surface of the holding portion 39 of the separation plate holder 32. The separation plate 31 is a single rectangular shaped flat plate that extends along the longitudinal direction of the fixing roller 132 matching the shaped of the holding portion 39. Furthermore, the separation plate 31 is set having a thickness of 0.2 mm and a fluorocarbon resin coating is implemented on its surface. The separation plate 31 is secured by welding for example to a lower surface of the holding portion 39.

The separation plate 31 has an edge (right edge in FIG. 4) that extends along the longitudinal direction of the fixing roller 132, and in a state in which the separation plate 31 is secured to the holding portion 39 and the separation mechanism 30A is in opposition to the fixing roller 132, a right edge 31*a* protrudes by a predetermined distance from the lower surface of the holding portion 39 toward the peripheral surface of the fixing roller 132. Furthermore, the separation plate 31 is provided with one end and the other end in opposition to the longitudinal direction of the fixing roller 132, that is, along the support shaft member 35, which is described later. And as shown in FIG. 4, the right edge 31*a* of the separation plate 31 is in opposition to the surface 133*a* of the fixing belt 133 wound around the fixing roller 132 with a predetermined gap G, for example a gap of 0.3 to 0.5 mm. With the thus-configured separation plate 31, in a case where a paper that has passed through the nip area NP and is discharged from the nip area NP while stuck to the surface 133*a* of the fixing belt 133, the paper can be stripped from the surface 133*a* of the fixing belt 133 by the right edge 31*a* contacting the paper that is stuck to the fixing belt 133.

Furthermore, the holder main body portion 37 of the separation plate holder 32 is provided with a front edge and a rear edge that are in opposition to the longitudinal direction of the holder main body portion 37. As shown in FIG. 3 to FIG. 5, a first support wall 40 that rises upward is formed at the front edge, and a second support wall 41 that rises upward is also formed at the rear edge. A first pivot support hole 42 and a second pivot support hole 43, both of which are set on the same axis, are formed at the first support wall 40 and the second support wall 41 respectively. The support shaft member 35 is inserted through the first and second pivot support holes 42 and 43. Accordingly, in a state in which the support shaft member 35 is inserted through the first and second pivot support holes 42 and 43, the separation plate holder 32 is able to rotate centered on the support shaft member 35. The support shaft member 35 is supported at both ends by an unshown predetermined frame.

Further still, the upright wall 38 of the separation plate holder 32 is provided with pass-through holes 44, which are formed at a substantially central and upper edge in the longitudinal direction thereof. A first adjustment member 61, which is constituted by a screw member for example, rotatably is inserted into the pass-through hole 44.

Further still, the first support wall 40 of the separation plate holder 32 is provided with an orthogonal surface 45 that is orthogonal to the support shaft member 35, and the aforementioned first pivot support hole 42 is formed passing through this orthogonal surface 45. The first pivot support hole 42 is formed as an elongated hole that extends in a direction orthogonal to the direction in which the support shaft member 35 extends, and also in a direction S in which an imaginary surface from the support shaft member 35 towards the fixing roller 132 (nip NP) extends. On the other hand, as shown in FIG. 4, the second pivot support hole 43 formed at the second support wall 41 is a round hole that has been set such that a shaft portion of the support shaft member 35 can be inserted. Accordingly, the rear edge of the holder main body portion 37 including the second support wall 41 acts as a base in which there is no positional change with respect to the support shaft member 35 due to the presence of the round hole 43, while a remaining portion of the holder main body portion 37 including the first support wall 40 acts as a free end which can undergo free movement in the surface direction extending from the support shaft member 35 to the fixing roller 132 due to the presence of the elongated hole 42. Along with this, the separation plate 31 secured to the separation plate holder 32 is also provided with a base (the one end) corresponding to the base of the separation plate holder 32 and a free end corresponding to the free end of the separation plate holder 32 (that is, a remaining portion of the separation plate 31 including the other end).

Furthermore, the first support wall 40 is provided with a right edge facing the fixing roller 132 and a left edge facing a direction opposite to the right edge. A holding wall 46 is provided at the left edge at approximately 90 degrees with respect to the orthogonal surface of the first support wall 40 and extending parallel to the support shaft member 35. A pass-through hole is formed in the holding wall 46 and a pass-through hole 48 is formed at the shaft portion of the support shaft member 35 at a position having the same axis as the pass-through hole. And a second adjustment member 64, which is constituted by a screw member for example, is rotatably inserted into the pass-through hole of the holding wall 46 and the pass-through hole 48. Specifically, a shaft portion of the second adjustment member 64 is inserted into the pass-through hole of the holding wall 46 and its tip portion is inserted into the pass-through hole 48 of the support shaft member 35. In this manner, the second adjustment member 64 is supported by the holding wall 46 of the separation plate holder 32 and the support shaft member 35.

The support member 34, supporting the separation plate holder 32 and the support shaft member 35, includes a main body portion 50 whose cross section has a substantial L shape when viewed from the longitudinal direction of the fixing roller 132. The main body portion 50 is provided with a long narrow top wall 51 that extends along the longitudinal direction of the fixing roller 132, and a support wall 52, which extends downward from an edge (right edge in FIG. 2 and FIG. 4) extending in the longitudinal direction of the top wall 51 and is in opposition to the longitudinal direction of the upright wall 38. A pair of attachment walls 53 that extend further downward than the support wall 52 is provided at ends in the longitudinal direction of the support wall 52. The attachment walls 53 are provided with a right surface facing the fixing roller 132 and a left surface facing a direction opposite to the right surface. An abutting member 54 is attached at the right surface, and a pivot support wall 55 that protrudes leftward in FIG. 2 is provided at the left surface.

As shown in FIG. 2 and FIG. 5, the abutting members 54, which are attached at the right surface of each of the attachment walls 53 of the support member 34, are set in position so as to not interfere with the separation plate 31. Each of the abutting members 54 is provided with a tip portion 54*a*, which is set in position at a height substantially equivalent to the right edge 31*a* of the separation plate 31 as viewed from the longitudinal direction of the fixing roller 132. Each of the tip portion s 54*a* of the abutting members 54 protrudes further rightward than the right edge 31*a* of the separation plate 31, and is held in a contact state against the longitudinal ends of the fixing roller 132 (in fact, width direction ends of the fixing belt 133) by a biasing member 56 (see FIG. 2 and FIG. 4). It should be noted that the longitudinal ends (width direction ends) contacted by the abutting member 54 indicate a range outside the longitudinal ends of a largest paper passing area among paper passing areas set for the nip area NP in response to the sizes of papers that pass through the nip area NP.

The biasing member 56 is constituted by two spring members arranged at a left side of the support member 34 at positions corresponding to the longitudinal ends of the top wall 51 of the support member 34. Engagement holes 57 are formed at longitudinal ends respectively of the top wall 51. One end of each spring member 56 is engaged in the engagement hole 57, and the other end is engaged to an unshown predetermined member of the fixing device 13. Due to these spring members 56, the support members 34 are pulled leftward by way of the top wall 51 and rotate centering on the support shaft member 35, and therefore the tip portion 54*a* of the abutting member 54 is held in a contact state against the fixing roller 132 through the fixing belt 133.

The abutting member 54 abuts the longitudinal ends of the fixing roller 132, and therefore even in a case where the fixing roller 132 or the fixing belt 133 undergoes thermal expansion or oscillation during the fixing process, the abutting member 54 follows the deformation of the fixing roller 132 and fixing belt 133 caused by the thermal expansion or oscillation, and rotates centering on the support shaft member 35. Due to this, the gap G between the right edge 31*a* of the separation plate 31 and the surface 133*a* of the fixing belt 133 can be maintained at a magnitude of 0.3 to 0.5 mm.

On the other hand, at the pair of pivot support walls 55 arranged at the left surfaces of the attachment walls 53 are formed pivot support holes 55*a*, which are set on the same shaft as each other, and are set on the same shaft as the first pivot support hole 42 of the first support wall 40 and the second pivot support hole 43 of the second support wall 41 of the separation plate holder 32. Accordingly, in a state in which the support shaft member 35 is inserted into the pivot support holes 55*a* of the support member 34 and the first and second pivot support holes 42 and 43 of the separation plate holder 32, the support member 34 can rotate on the same shaft as the separation plate holder 32.

Furthermore, as shown in FIG. 3, the support wall 52 of the support member 34 is provided with pass-through holes 58, which are formed near a substantially central and upper edge in the longitudinal direction thereof. As shown in FIG. 4, the pass-through holes 58 are set in position so as to be on the same axis as the pass-through holes 44 of the upright wall 38 of the separation plate holder 32. A tip portion of the screw member, which is the first adjustment member 61 inserted into the pass-through hole 44 of the separation plate holder 32, is rotatably inserted into and supported by the pass-through hole 58. In this manner, the first adjustment member 61 is supported by the support member 34 and the separation plate holder 32.

A first biasing member 62, which is a spring member for example, is fitted freely on the shaft portion of the first adjustment member (screw member) 61, which is rotatably supported by the support member 34 and the separation plate holder 32. The first biasing member (spring member) 62 is arranged such that one of its ends contacts the upright wall 38 of the separation plate holder 32, and its other end contacts the support wall 52 of the support member 34, and therefore a biasing force is applied between the upright wall 38 of the separation plate holder 32 and the support wall 52 of the support member 34 such that these are kept apart from each other. Due to the biasing force of the first biasing member 62, the separation plate holder 32 tries to rotate centering on the support shaft member 35 (counterclockwise rotation in FIG. 4). Due to this counterclockwise rotation, the separation plate 31, which is secured at the separation plate holder 32, moves toward the surface 133*a* of the fixing belt 133.

However, since the upright wall 38 of the separation plate holder 32 and the support wall 52 of the support member 34 are linked by the first adjustment member 61, specifically, by adjusting the rotation amount of the first adjustment member 61, and adjusting the distance between the upright wall 38 of the separation plate holder 32 and the support wall 52 of the support member 34, the biasing force of the first biasing member 62 can be regulated, and therefore the counterclockwise rotation of the separation plate holder 32 is allowed only in a predetermined range, and along with this, movement of the separation plate 31 also is allowed only in a predetermined range. In this manner, the gap G between the right edge 31*a* of the separation plate 31 and the surface 133*a* of the fixing belt 133 can be maintained at a magnitude of the aforementioned range of 0.3 to 0.5 mm by adjusting the rotation amount of the separation plate holder 32. In the first embodiment, the first adjustment member 61 and the first biasing member 62 constitute a first gap adjustment unit 60 that is capable of adjusting the gap G in the rotation direction of the separation plate holder 32.

On the other hand, a second biasing member 65, which is a spring member for example, is fitted freely on the shaft portion of the second adjustment member 64, which is rotatably supported by the holding wall 46 of the separation plate holder 32 and the support shaft member 35. The second biasing member 65 is arranged such that one of its ends contacts the holding wall 46, and its other end contacts the support shaft member 35, and therefore a biasing force is applied such that the separation plate holder 32 is kept apart from the support shaft member 35. Due to the biasing force of the second biasing member 65, the free end of the separation plate holder 32 including the first support wall 40 is guided into the elongated hole 42 of the first support wall 40 and moves freely in the surface direction S extending from the support shaft member 35 to the fixing roller 132, specifically, the free end of the separation plate holder 32 moves within the range of the elongated hole 42 in a direction apart from the fixing belt 133. Due to movement of the free end, the free end of the separation plate 31, which is secured at the separation plate holder 32, also moves apart from the surface 133*a* of the fixing belt 133.

However, since the holding wall 46 of the separation plate holder 32 and the support shaft member 35 are linked by the second adjustment member 64, specifically, the biasing force of the second biasing member 65 can be regulated by adjusting the distance between the holding wall 46 and the support shaft member 35 by appropriately adjusting the rotation amount of the second adjustment member 64, and therefore the surface direction free movement of the free end of the separation plate holder 32 is allowed only in a predetermined range. Along with this, surface direction free movement of the separation plate 31 also is allowed only in a predetermined range. In this manner, the gap G between the right edge 31*a* of the separation plate 31 and the surface 133*a* of the fixing belt 133 can be maintained at a magnitude of the aforementioned range of 0.3 to 0.5 mm by adjusting the free movement amount of the separation plate holder 32. In the first embodiment, the second adjustment member 64 and the second biasing member 65 constitute a second gap adjustment unit 63 that is capable of adjusting the gap G in the surface direction.

With the separation mechanism 30A described above, the gap G between the right edge 31*a* of the separation plate 31 and the surface 133*a* of the fixing belt 133 can be adjusted in the rotation direction of the separation plate holder 32 by the first gap adjustment unit 60 (the first adjustment member 61 and the first biasing member 62), and also can be adjusted in the surface direction S extending from the support shaft member 35 towards the fixing roller 132 by the second gap adjustment unit 63 (the second adjustment member 64 and the second biasing member 65). With this two-directional gap adjustment, it is easy to set the gap G to a predetermined magnitude even though the separation plate 31 is a single flat plate member and there is unevenness in the dimensional precision among separation plates 31.

Second Embodiment

Figure 6:
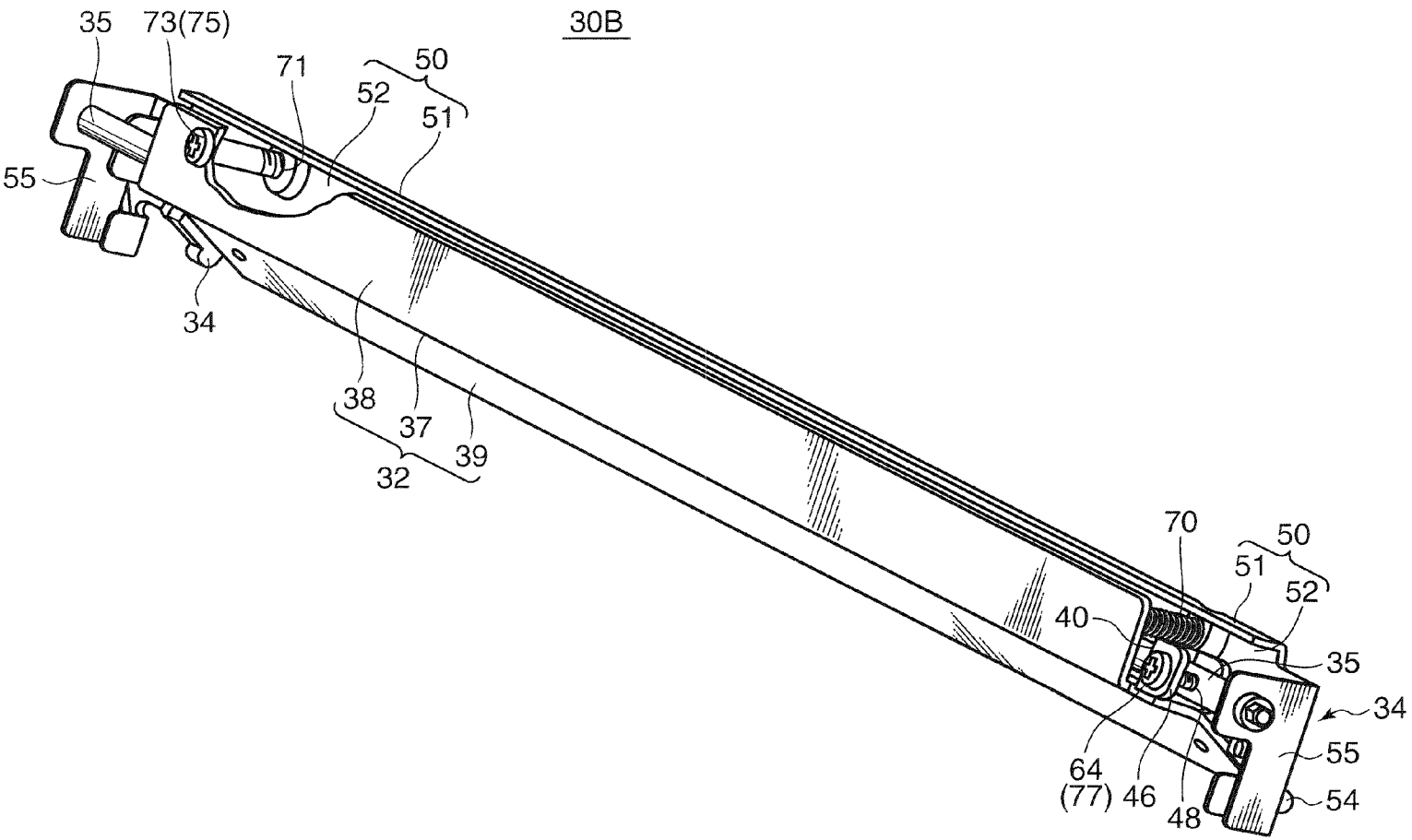
FIG. 6 is a perspective view of a separation mechanism of a fixing device according to a second embodiment as viewed from a left side.

Next, description is given with reference to FIG. 6 regarding the fixing device 13 according to a second embodiment, and particularly in regard to a separation mechanism 30B. In a similar manner as FIG. 3, FIG. 6 is a perspective view of the separation mechanism 30B as seen from the left side. Instead of the first biasing member 62 of the first gap adjustment unit 60 and the second biasing member 65 of the second gap adjustment unit 63 that were used in the first embodiment, the separation mechanism 30B employs a single biasing member 70, and this point is the major difference between it and the separation mechanism 30A of the first embodiment. Hereinafter, specific description is given regarding the single biasing member 70.

The single biasing member 70 is a spring member for example that is arranged between the upright wall 38 of the separation plate holder 32 and the support wall 52 of the support member 34 in the vicinity of the first support wall 40 of the separation plate holder 32, that is, in the vicinity of the elongated hole 42 that allows free movement in the aforementioned surface direction S of the separation plate holder 32, and one end thereof contacts the upright wall 38 and the other end thereof contacts the support wall 52. It should be noted that the single biasing member 70 is arranged so as to not contact the support shaft member 35.

Furthermore, pass-through holes are formed at a rear end and an upper end in the longitudinal direction of the upright wall 38 of the separation plate holder 32, and a pass-through hole 71 is also formed at a position so to be on the same axis as the pass-through hole in the support wall 52 of the support member 34, and a first adjustment member 73, which is constituted by a screw member for example, is rotatably supported by the aforementioned pass-through hole of the upright wall 38 and the pass-through hole 71 of the support wall 52. Specifically, a shaft portion of the first adjustment member 73 is inserted into the aforementioned pass-through hole of the upright wall 38 and its tip portion is inserted into the pass-through hole 71 of the support wall 52.

Furthermore, in a similar manner as the first embodiment, in the second embodiment also, the aforementioned rear end, in which the second support wall 41 is provided in the holder main body portion 37 of the separation plate holder 32, acts as a base, and the remaining section of the holder main body portion 37 including the first support wall 40 acts as a freely movable end. Similarly, the separation plate 31 secured to the separation plate holder 32 is also provided with a base corresponding to the aforementioned base of the separation plate holder 32 and a freely movable end corresponding to the aforementioned freely movable end of the separation plate holder 32. Other components of the separation mechanism 30B are equivalent to the separation mechanism 30A in the first embodiment, and therefore description thereof is omitted.

In the thus configured separation mechanism 30B, the single biasing member 70 causes a biasing force to act so that the separation plate holder 32 and the support member 34 move apart from each other, and causes the separation plate holder 32 to rotate (counterclockwise rotation in FIG. 6) centering on the support shaft member 35. Furthermore, simultaneously, the single biasing member 70 causes a biasing force to act so that the separation plate holder 32 moves apart from the support shaft member 35, and causes the aforementioned end of the separation plate holder 32 to move freely within the range of the elongated hole 42 in the surface direction S, which extends from the support shaft member 35 toward the fixing roller 132. In this way, in the second embodiment, by using a single spring member 70, the separation plate holder 32 is allowed to rotate around the support shaft member 35 and move freely in the surface direction S. And in the same manner as the first embodiment, rotation and free movement of the separation plate holder 32 are adjusted by the first adjustment member 73 and the second adjustment member 64 respectively. Hereinafter, description is given regarding adjustments using the first adjustment member 73 and the second adjustment member 64.

The first adjustment member 73, although the position in which it is arranged is different from the first adjustment member 61 of the first embodiment, has an equivalent effect. That is, with the first adjustment member 73, since the upright wall 38 of the separation plate holder 32 and the support wall 52 of the support member 34 are linked, the biasing force of the single biasing member 70 can be regulated by appropriately adjusting the rotation amount of the first adjustment member 73 to adjust the distance between the upright wall 38 of the separation plate holder 32 and the support wall 52 of the support member 34. In this way, counterclockwise rotation of the separation plate holder 32 is allowed only in a predetermined range, and along with this, the movement of the separation plate 31, which is secured to the separation plate holder 32, is also allowed only in a predetermined range. In this manner, the gap G between the right edge 31*a* of the separation plate 31 and the surface 133*a* of the fixing belt 133 can be maintained at a magnitude of the aforementioned range of 0.3 to 0.5 mm by adjusting the rotation amount of the separation plate holder 32. In the second embodiment, the first adjustment member 73 along with the single biasing member 70 constitute a first gap adjustment unit 75 that is capable of adjusting the gap G in the rotation direction of the separation plate holder 32.

On the other hand, the second adjustment member 64 also has an equivalent effect as the second adjustment member 64 of the first embodiment. That is, with the second adjustment member 64, since the holding wall 46 of the first support wall 40 of the separation plate holder 32 and the support shaft member 35 are linked, the biasing force of the single biasing member 70 can be regulated by appropriately adjusting the rotation amount of the second adjustment member 64 to adjust the distance between the holding wall 46 and the support shaft member 35. In this way, free movement of the aforementioned free end of the separation plate holder 32 is allowed only in a predetermined range, and along with this, free movement of the separation plate 31 in the surface direction of the aforementioned free end is also allowed only in a predetermined range. In this manner, the gap G between the right edge 31*a* of the separation plate 31 and the surface 133*a* of the fixing belt 133 can be maintained at a magnitude of the aforementioned range of 0.3 to 0.5 mm also by adjusting the free movement amount of the separation plate holder 32. In the second embodiment, the second adjustment member 64, along with the single biasing member 70, constitutes a second gap adjustment unit 77 that is capable of adjusting the gap G in the surface direction.

With the above-described separation mechanism 30B, the gap G between the right edge 31*a* of the separation plate 31 and the surface 133*a* of the fixing belt 133 can be adjusted from two directions in a similar manner as the separation mechanism 30A of the first embodiment, and therefore it is easy to set the gap G to a predetermined magnitude even though the separation plate 31 is a single flat plate member and there is unevenness in the dimensional precision among separation plates 31.

Furthermore, the first gap adjustment unit 75 and the second gap adjustment unit 77 use a common biasing member 70, and therefore compared to a configuration in which separate biasing members are provided to the first gap adjustment unit 75 and the second gap adjustment unit 77 respectively, the structure of the separation mechanism 30B can be simplified and cost reductions can be achieved through reductions in the number of components.

In the above-described first embodiment and second embodiment according to the present invention, description has been given regarding the configuration in which screw members are employed as the first adjustment members 61 and 73 and the second adjustment member 64, but instead of screw members, it is also possible to employ a configuration that presses using an eccentric rubber for example.

It is preferable that the above-described image forming apparatus according to the present embodiment, and in particular the fixing device used in such image forming apparatuses, has a configuration that is indicated hereinafter.

The fixing device preferably includes a fixing member, a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone the fixing process. The separation mechanism includes a separation member extending in a direction orthogonal to the paper convey direction and arranged opposite the fixing member in a state apart from the fixing member by a predetermined gap, a support shaft member extending in a direction orthogonal to the paper convey direction and rotatably supporting the separation member, a first gap adjustment unit capable of rotating the separation member around the support shaft member to adjust the predetermined gap in the rotation direction, and a second gap adjustment unit capable of moving the separation member in a direction in which an imaginary surface from the support shaft member towards the fixing member extends, to adjust the predetermined gap in the surface direction.

With the fixing device of the above-described configuration, the gap between the separation member and the fixing member can be adjusted in the rotation direction of the separation member, using the first gap adjustment unit and can also be adjusted in the surface direction, which extends from the support shaft member toward the fixing member, using the second gap adjustment unit. With this two-directional gap adjustment, it is easy to set the gap G to a predetermined magnitude.

With the fixing device of the above-described configuration, it is preferable that the separation member is a single flat plate member having one end and the other end along the support shaft member, and the second gap adjustment unit allows the other end to move freely relative to the one end defined as a base that is fixed in position with respect to the support shaft member, so as to adjust the predetermined gap in the surface direction.

With this configuration, the one end of the separation member acts as a base whose position does not change with respect to the support shaft member and the other end acts as a freely movable end, and therefore the magnitude of the gap can be adjusted easily in the surface direction even when the separation member is a single flat plate section.

With the fixing device of the above-described configuration, it is preferable that the first gap adjustment unit has a first biasing member biasing the separation member to rotate the separation member, and a first adjustment member regulating a biasing force of the first biasing member to adjust a rotation amount of the separation member, and also preferable that the second gap adjustment unit has a second biasing member biasing the other end of the separation member to cause the other end to move freely in the surface direction, and a second adjustment member regulating a biasing force of the second biasing member to adjust a free movement amount of the separation member in the surface direction.

With the fixing device of the above-described configuration, it is preferable that: the separation mechanism further includes a single biasing member arranged in the vicinity of the other end of the separation member, and the single biasing member is arranged at a position that enables the single biasing member to bias a portion adjacent the other end in the separation member to rotate the separation member around the support shaft member and also to move the other end of the separation member freely in the surface direction, the first gap adjustment unit has a first adjustment member regulating a biasing force of the single biasing member to adjust a rotation amount of the separation member, and the second gap adjustment unit has a second adjustment member regulating a biasing force of the single biasing member to adjust an amount of the free movement of the separation member in the surface direction.

With this configuration, the first gap adjustment unit and the second gap adjustment unit are provided with a common biasing member, and therefore compared to a configuration in which separate biasing members are provided to the first gap adjustment unit and the second gap adjustment unit respectively, the structure of the separation mechanism can be simplified and cost reductions can be achieved through reductions in the number of components.

With the fixing device of the above-described configuration, it is preferable that: the separation mechanism further includes a separation member holder on which the separation member is attached and which is so supported rotatably by the support shaft member that the separation member moves towards or away from the fixing member, the separation member holder has an elongated hole through which the support shaft member is inserted and which extends in a direction of the free movement of the other end of the separation member, and the second biasing member biases the separation member holder, on which the separation member is attached, to move the separation member holder freely within the range of the elongated hole.

With the fixing device of the above-described configuration, it is preferable, in a case where the single biasing member is being used, that the single biasing member biases the separation member holder, on which the separation member is attached, to move the separation member holder freely within the range of the elongated hole.

With these configurations, the gap between the separation member and the fixing member can be adjusted in the surface direction using a simple structure in which an elongated hole, which extends in the free movement direction of the other end of the separation member, is formed in the separation member holder to which the separation member is attached.

With the fixing device of the above-described configuration, it is preferable that: the fixing member is a fixing belt extending in a direction orthogonal to the convey direction of the paper, the pressing member is a roller member extending in a direction orthogonal to the convey direction and forming the nip area with the fixing belt in the orthogonal direction, the fixing belt has a paper passing area defined according to a size of the paper that passes the nip area, the separation mechanism further includes a support member that is supported by the support shaft member and is rotatable on the same axis as the separation member holder, the support member has an abutting member attached thereto, and the abutting member is held in contact with longitudinal ends of the fixing belt in which the paper passing area is not defined.

With this configuration, the abutting member contacts the longitudinal ends of the fixing belt, and therefore even in a case where the fixing belt undergoes thermal expansion or oscillation during the fixing process, the abutting member can rotate following the deformation of the fixing belt caused by the thermal expansion or oscillation. Due to this, the gap between separation member and the fixing belt can be maintained at a predetermined magnitude.

With the fixing device of the above-described configuration, it is preferable that the second biasing member is a spring member, the separation member holder has a holder main body portion to which the separation member is attached, a support wall in which the elongated hole is formed, and a holding wall that extends parallel to the support shaft member, and the second biasing member is arranged so that one end thereof contacts the holding wall and the other end thereof contacts the support shaft member.

With the fixing device of the above-described configuration, it is preferable that the second adjustment member is a screw member and has a shaft portion rotatably supported by the holding wall, and a tip portion rotatably supported by the support shaft member, and the spring member is loosely fitted on the shaft portion of the screw member between the holding wall and the support shaft member.

With the fixing device of the above-described configuration, it is preferable that the separation mechanism further includes a separation member holder on which the separation member is attached and which is so supported rotatably by the support shaft member that the separation member moves towards or away from the fixing member, and a support member that is supported by the support shaft member and is rotatable on the same axis as the separation member holder. It is also preferable that: the separation member holder has a holder main body portion to which the separation member is attached, and an opposing wall that is in opposition to the support member, the first biasing member is arranged between the support member and the opposing wall, and the first adjustment member is a screw member and has a shaft portion rotatably supported by the opposing wall and a tip portion rotatably supported by the support member.

This application is based on Japanese Patent Application Serial No. 2009-045261, filed in Japan Patent Office on Feb. 27, 2009 respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A fixing device, comprising:

a fixing member;

a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone the fixing process, wherein the separation mechanism includes:

a separation member extending in a direction orthogonal to the paper convey direction and arranged opposite the fixing member in a state apart from the fixing member by a predetermined gap, a support shaft member extending in a direction orthogonal to the paper convey direction and rotatably supporting the separation member, a first gap adjustment unit capable of rotating the separation member around the support shaft member to adjust the predetermined gap in a rotation direction, and having a first biasing member biasing the separation member to rotate the separation member, and a first adjustment member regulating a biasing force of the first biasing member to adjust a rotation amount of the separation member, and a second gap adjustment unit capable of moving the separation member in a direction in which an imaginary surface from the support shaft member towards the fixing member extends, to adjust the predetermined gap in a surface direction, wherein the separation member is a single flat plate member having one end and an other end along the support shaft member, and the second gap adjustment unit allows the other end to move freely relative to the one end defined as a base that is fixed in position with respect to the support shaft member, so as to adjust the predetermined gap in the surface direction, and the second gap adjustment unit has a second biasing member biasing the other end of the separation member to cause the other end to move freely in the surface direction, and a second adjustment member regulating a biasing force of the second biasing member to adjust a free movement amount of the separation member in the surface direction.

2. The fixing device according to claim 1, wherein the separation mechanism further includes a single biasing member arranged in the vicinity of the other end of the separation member, the single biasing member is arranged at a position that enables the single biasing member to bias a portion adjacent the other end in the separation member to rotate the separation member around the support shaft member and also to move the other end of the separation member freely in the surface direction, the first gap adjustment unit has a first adjustment member regulating a biasing force of the single biasing member to adjust a rotation amount of the separation member, and the second gap adjustment unit has a second adjustment member regulating a biasing force of the single biasing member to adjust an amount of the free movement of the separation member in the surface direction.

3. The fixing device according to claim 2, wherein the separation mechanism further includes a separation member holder on which the separation member is attached and which is so supported rotatably by the support shaft member that the separation member moves towards or away from the fixing member, the separation member holder has an elongated hole through which the support shaft member is inserted and which extends in a direction of the free movement of the other end of the separation member, and the single biasing member biases the separation member holder, on which the separation member is attached, to move the separation member holder freely within the range of the elongated hole.

4. The fixing device according to claim 1, wherein the separation mechanism further includes a separation member holder on which the separation member is attached and which is so supported rotatably by the support shaft member that the separation member moves towards or away from the fixing member, the separation member holder has an elongated hole through which the support shaft member is inserted and which extends in a direction of the free movement of the other end of the separation member, and the second biasing member biases the separation member holder, on which the separation member is attached, to move the separation member holder freely within the range of the elongated hole.

5. The fixing device according to claim 4, wherein the fixing member is a fixing belt extending in a direction orthogonal to the convey direction of the paper, the pressing member is a roller member extending in a direction orthogonal to the convey direction and forming the nip area with the fixing belt in the orthogonal direction, the fixing belt has a paper passing area defined according to a size of the paper that passes the nip area, the separation mechanism further includes a support member that is supported by the support shaft member and is rotatable on the same axis as the separation member holder, the support member has an abutting member attached thereto, and the abutting member is held in contact with longitudinal ends of the fixing belt in which the paper passing area is not defined.

6. The fixing device according to claim 4, wherein the second biasing member is a spring member, the separation member holder has a holder main body portion to which the separation member is attached, a support wall in which the elongated hole is formed, and a holding wall that extends parallel to the support shaft member, and the second biasing member is arranged so that one end thereof contacts the holding wall and the other end thereof contacts the support shaft member.

7. The fixing device according to claim 6, wherein the second adjustment member is a screw member and has a shaft portion rotatably supported by the holding wall, and a tip portion rotatably supported by the support shaft member, and the spring member is loosely fitted on the shaft portion of the screw member between the holding wall and the support shaft member.

8. The fixing device according to claim 1, wherein the separation mechanism further includes a separation member holder on which the separation member is attached and which is so supported rotatably by the support shaft member that the separation member moves towards or away from the fixing member, and a support member that is supported by the support shaft member and is rotatable on the same axis as the separation member holder, the separation member holder has a holder main body portion to which the separation member is attached, and an opposing wall that is in opposition to the support member, the first biasing member is arranged between the support member and the opposing wall, and the first adjustment member is a screw member and has a shaft portion rotatably supported by the opposing wall and a tip portion rotatably supported by the support member.

9. An image forming apparatus, comprising:

an image forming section forming a toner image on a paper; and a fixing device fixing the toner image on the paper, the fixing device including:

a fixing member;

a pressing member held in contact with the fixing member to form a nip area therebetween, the fixing member and the pressing member operable to sandwich a paper, on which a toner image has been formed, at the nip area and fix the toner image onto the paper, and a separation mechanism arranged on a downstream side of the fixing member in a convey direction of the paper and capable of stripping from the fixing member the paper that has undergone the fixing process, wherein the separation mechanism includes:

a separation member extending in a direction orthogonal to the paper convey direction and arranged opposite the fixing member in a state apart from the fixing member by a predetermined gap, a support shaft member extending in a direction orthogonal to the paper convey direction and rotatably supporting the separation member, a first gap adjustment unit capable of rotating the separation member around the support shaft member to adjust the predetermined gap in a rotation direction, and having a first biasing member biasing the separation member to rotate the separation member, and a first adjustment member regulating a biasing force of the first biasing member to adjust a rotation amount of the separation member, and a second gap adjustment unit capable of moving the separation member in a direction in which an imaginary surface from the support shaft member towards the fixing member extends, to adjust the predetermined gap in a surface direction, wherein the separation member is a single flat plate member having one end and an other end along the support shaft member, and the second gap adjustment unit allows the other end to move freely relative to the one end defined as a base that is fixed in position with respect to the support shaft member, so as to adjust the predetermined gap in the surface direction, and the second gap adjustment unit has a second biasing member biasing the other end of the separation member to cause the other end to move freely in the surface direction, and a second adjustment member regulating a biasing force of the second biasing member to adjust a free movement amount of the separation member in the surface direction.

10. The image forming apparatus according to claim 9, wherein the separation mechanism further includes a single biasing member arranged in the vicinity of the other end of the separation member, the single biasing member is arranged at a position that enables the single biasing member to bias a portion adjacent the other end in the separation member to rotate the separation member around the support shaft member and also to move the other end of the separation member freely in the surface direction, the first gap adjustment unit has a first adjustment member regulating a biasing force of the single biasing member to adjust a rotation amount of the separation member, and the second gap adjustment unit has a second adjustment member regulating a biasing force of the single biasing member to adjust an amount of the free movement of the separation member in the surface direction.

11. The image forming apparatus according to claim 10, wherein the separation mechanism further includes a separation member holder on which the separation member is attached and which is so supported rotatably by the support shaft member that the separation member moves towards or away from the fixing member, the separation member holder has an elongated hole through which the support shaft member is inserted and which extends in a direction of the free movement of the other end of the separation member, and the single biasing member biases the separation member holder, on which the separation member is attached, to move the separation member holder freely within the range of the elongated hole.

12. The image forming apparatus according to claim 9, wherein the separation mechanism further includes a separation member holder on which the separation member is attached and which is so supported rotatably by the support shaft member that the separation member moves towards or away from the fixing member, the separation member holder has an elongated hole through which the support shaft member is inserted and which extends in a direction of the free movement of the other end of the separation member, and the second biasing member biases the separation member holder, on which the separation member is attached, to move the separation member holder freely within the range of the elongated hole.

13. The image forming apparatus according to claim 12, wherein the fixing member is a fixing belt extending in a direction orthogonal to the convey direction of the paper, the pressing member is a roller member extending in a direction orthogonal to the convey direction and forming the nip area with the fixing belt in the orthogonal direction, the fixing belt has a paper passing area defined according to a size of the paper that passes the nip area, the separation mechanism further includes a support member that is supported by the support shaft member and is rotatable on the same axis as the separation member holder, the support member has an abutting member attached thereto, and the abutting member is held in contact with longitudinal ends of the fixing belt in which the paper passing area is not defined.

14. The image forming apparatus according to claim 12, wherein the second biasing member is a spring member, the separation member holder has a holder main body portion to which the separation member is attached, a support wall in which the elongated hole is formed, and a holding wall that extends parallel to the support shaft member, and the second biasing member is arranged so that one end thereof contacts the holding wall and the other end thereof contacts the support shaft member.

15. The image forming apparatus according to claim 14, wherein the second adjustment member is a screw member and has a shaft portion rotatably supported by the holding wall, and a tip portion rotatably supported by the support shaft member, and the spring member is loosely fitted on the shaft portion of the screw member between the holding wall and the support shaft member.

16. The image forming apparatus according to claim 9, wherein the separation mechanism further includes a separation member holder on which the separation member is attached and which is so supported rotatably by the support shaft member that the separation member moves towards or away from the fixing member, and a support member that is supported by the support shaft member and is rotatable on the same axis as the separation member holder, the separation member holder has a holder main body portion to which the separation member is attached, and an opposing wall that is in opposition to the support member, the first biasing member is arranged between the support member and the opposing wall, and the first adjustment member is a screw member and has a shaft portion rotatably supported by the opposing wall and a tip portion rotatably supported by the support member.

* * * * *